US005303567A

United States Patent [19]

Nava

[11] Patent Number: 5,303,567

[45] Date of Patent: Apr. 19, 1994

[54] PADLOCK WITH KEY INDICATOR

[76] Inventor: Henry P. Nava, 443 Potrero Grande Dr., Monterey Park, Calif. 91754

[21] Appl. No.: 993,646

[22] Filed: Dec. 21, 1992

[51] Int. Cl.[5] ..... E05B 15/08

[52] U.S. Cl. ..... 70/38 B; 70/54; 70/454; 70/460; 40/299

[58] Field of Search ..... 70/38 R:38 A, 38 B, 70/38 C, 39, 51, 54–56, 438, 441, 453, 454, 460; 40/299, 634

[56] References Cited

U.S. PATENT DOCUMENTS

| | | | |
|---|---|---|---|
| 952,254 | 3/1910 | Jackson | 70/453 |
| 1,316,663 | 9/1919 | Zadorozny | 70/51 |
| 1,527,336 | 2/1925 | Voda | 70/39 |
| 1,751,153 | 3/1930 | Hauser | 70/454 |
| 1,868,563 | 7/1932 | Cicourel | 70/460 |
| 2,632,266 | 3/1953 | Sellwood | 70/454 |
| 4,112,715 | 9/1978 | Uyeda | 70/38 A |
| 4,253,321 | 3/1981 | Sorensen | 70/456 R |
| 4,317,344 | 3/1982 | Barnard | 70/55 |
| 4,913,981 | 4/1990 | Hynes et al. | 40/299 X |
| 5,109,686 | 5/1992 | Toussant | 70/454 |

FOREIGN PATENT DOCUMENTS

| | | | |
|---|---|---|---|
| 823431 | 1/1938 | France | 70/454 |
| 1147113 | 11/1957 | France | 70/454 |

*Primary Examiner*—Peter M. Cuomo
*Assistant Examiner*—Suzanne L. Dino
*Attorney, Agent, or Firm*—William W. Haefliger

[57] ABSTRACT

A padlock having a body, a U-shaped keeper at one end of the body, and a key receptor at the opposite end of the body, the body containing a row of pieces to be engaged by key teeth comprising an indicator device on the body; the device having a location on the body relative to the pieces to indicate the left or right directional orientation of key teeth insertion into the reception, to effect opening of the padlock keeper.

10 Claims, 2 Drawing Sheets

PADLOCK WITH KEY INDICATOR

BACKGROUND OF THE INVENTION

The present invention relates generally to padlocks, and particularly to those having a built-in or accessory indicator to indicate to the user how he should position the padlock key in order to open the lock.

A conventional key-operated padlock comprises a body containing a key receptor cylinder and an attached U-shaped keeper in the form of a shackle, chain, or cable, or varied combinations of such components. The keeper parts are attached to the body at one end, or both ends, becoming secured to the body when the lock is in a closed locked position.

The conventional locked padlock requires for its opening that a key be inserted into a key cylinder in the body of the lock. The key cylinder typically has pins that are presented to be actuated by the key teeth into a specific position which releases one or both ends of the retaining shackle or keeper.

Conventional padlocks do not assist the user to position the key in the user's hand in the proper manner so as to always insert the key into the key slot with the key teeth presented to engage the pins. Only one half of the time can the user guess which direction to point the teeth of the key for the key to enter. The other half of the time the user must take the time to revolve the key 180 degrees in his hand prior to insertion of the key.

There is need for means to indicate which direction the teeth or notches of the key must face in order to enter the keyway; however, there is, at present, no instruction, attachment, guide, or visual configuration on the lock to tell the user how to properly position the key in his hand to enable the key to enter the slot.

SUMMARY OF THE INVENTION

It is a major object of the invention to provide means to meet the above-described need, and to overcome the key orientation problem, in a simple, effective manner. Basically, the invention is embodied in a padlock having a body, a U-shaped keeper at one end of the body, and a key receptor at the opposite end of the body, the body containing a row of pins to be engaged by key teeth. In this environment, the invention comprises:

a) an indicator device on the body, b) the device having a physical feature located on the body relative to the pins to indicate the left or right directional orientation of key teeth insertion into the reception, to effect opening of the padlock keeper.

As will be seen, the indicator means typically and advantageously comprises notch means on the body, the notch means preferably including a row of notches extending in the direction of key insertion, for ease of finger touching, as in the dark.

Accordingly, the padlock immediately indicates to the user the proper position in which to hold the key, in order to orient the teeth of the key so as to enter the key receptor slot. Such indication, by the appearance of the lock, occurs when the lock is in any position, when the lock is touched, or when the lock is located in a dark area and cannot be seen clearly but can be touched by the user. The notch means is such as to indicate, with no doubt, how the key must be held in order to enter the key slot and open the lock.

Other objects include the provision of notch means on the body close to one edge of the body; or on one leg of the U-shaped keeper closest to that side of the body toward which the key teeth must be presented for entry. In another form of the invention, the notch means is on a boot on the body.

These and other objects and advantages of the invention, as well as the details of an illustrative embodiment, will be more fully understood from the following specification and drawings, in which:

DRAWING DESCRIPTION

DETAILED DESCRIPTION

Figure 1:
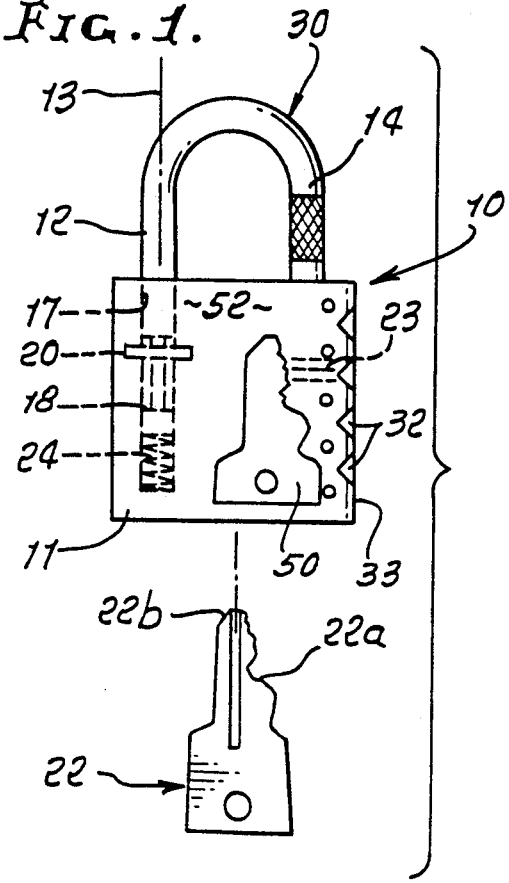
FIG. 1 is a side elevation showing one side of a padlock body.
Figure 2:
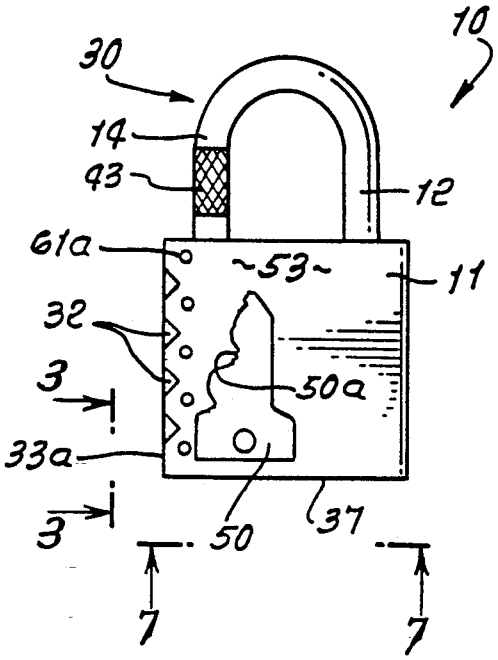
FIG. 2 is like FIG. 1 but showing the opposite side of the body.
Figure 3:
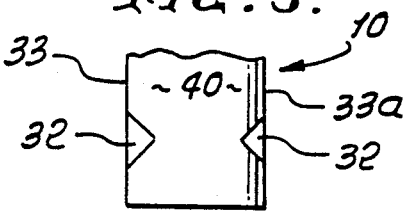
FIG. 3 is a view taken on lines 3—3 of FIG. 2.
Figure 6:
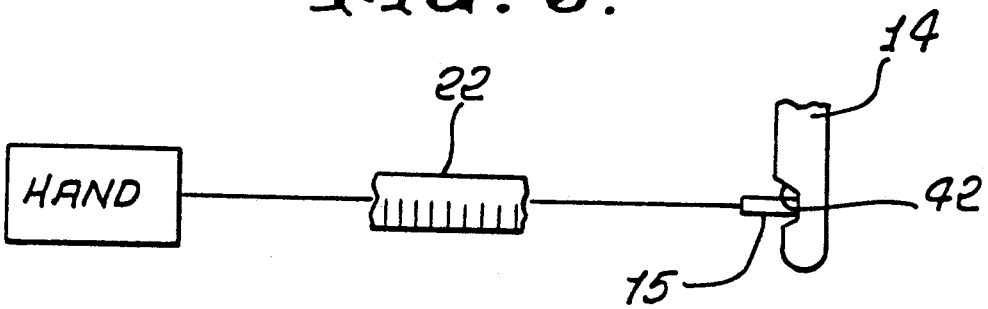
FIG. 6 is a schematic actuation diagram.
Figure 7:
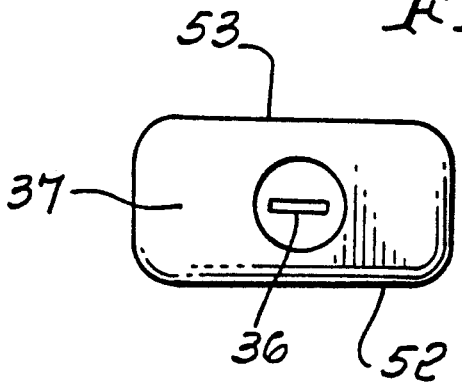
FIG. 7 is a view taken on lines 7—7 of FIG. 2.

In FIGS. 1-3 and 7, a padlock 10 has a body 11, and a U-shaped keeper 30 at one end of the body. The keeper has one leg 12 received in a body bore, and retained to swivel about axis 13, and to move between upper and lower positions. In upper position, the keeper second leg 14 is "unlocked"; and in lower position, the keeper second leg 14 is latched by a key releasable dog 15, as seen in FIG. 6. FIG. 1 also shows a bore 17 in the body in which the lower end of leg 12 swivels. Stop shoulder 18 on the leg is engageable with a stop 20 in the body to limit up and down movement of the keeper and its legs. These showings are intended to be diagrammatic and to illustrate conventional padlock action.

In FIG. 6, the leg 14 has a side slot 42 in which spring-urged dog 15 enters. When key 22 is inserted into the padlock body to engage pins 23 in a row, the dog 15 retracts from slot 42 and releases leg 14, allowing the spring 24 in the body to push leg 12 and keeper 30 to unlocked position.

In accordance with the invention, an indicator device is provided on the body, the device having a location on the body relative to the pins to indicate the left or right directional orientation of key teeth insertion into the receptor, to effect opening of the padlock keeper. That device preferably comprises notch means on the body, as for example a row of notches located in proximity to a edge of the body toward which the key teeth are to be presented. As shown, the notches 32, in a row, are formed in an edge 33 of the body; the pins to be engaged by teeth **22*a* of key 22, are shown at 23**.

Preferably, the V-notches 32 are cut into parallel edges 33 and **33*a* on opposite sides of the body (see FIGS. 1-3), to be readily felt by the user's fingers, groping in the dark, for example, so that no matter which side of the lock is presented, the user will be quickly able to discern the direction toward which the teeth 22*a* of the key must be laterally or sidewardly presented, as the tip 22*b* of the key is longitudinally inserted into the receptor opening 36 in the end 37 of the body. Notches may also be presented on the leg 14 closest the notched body side 40. The notches on the leg 14 may take the form of knurling 43** on and about that leg.

Also provided is a graphic representation 50 of a key applied to each side face 52 and 53 of the lock body, with teeth **50*a* presented toward notches 32. This also visually assists the user to properly orient his key, as shown, to engage the pins in the lock body. The representation 50** may be in the form of a label, engraving or decal, or other sheet, adhered to the body face.

Figure 4:
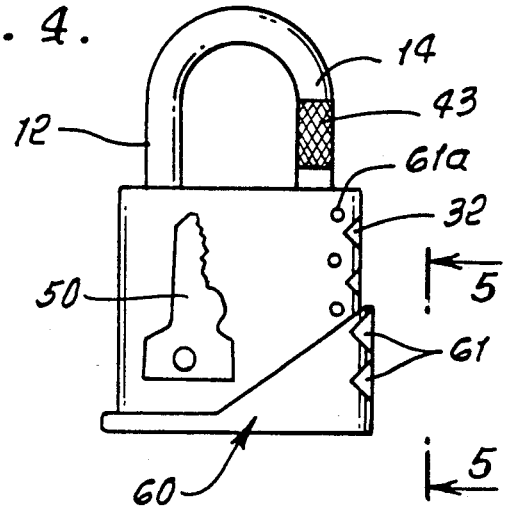
FIG. 4 is a view like FIG. 1 but showing a boot on the body with notch means.
Figure 5:
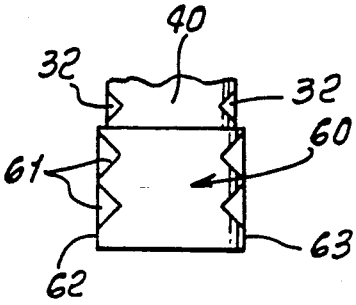
FIG. 5 is a view taken on lines 5—5 of FIG. 4.

FIGS. 4 and 5 show a boot 60 attached to the lock body and having associated notches 61 on its corners 62 and 63 that overlie the body edges into which notches are cut. See also the representations 50, as in FIGS. 1 and 2. Boot 60 is elongated away from end 37 and at the body edge 33, which is notched. Such elongation also serves as an indicator, as referred to.

Referring again to FIGS. 1, 2 and 4, small projections or indentations 61*a* may be formed in the body sides 52 and 53, near edges 33 and 33*a*, to also serve as indicators. The user's fingers or the thumb may sense the locations of 61*a*, to enable correct key orientation, as referred to above for notches 32.

I claim:

1. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, said indicator device having shoulders presented in a row extending in the direction of key insertion.

2. In combination with a lock having a body, a keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the keeper, said indicator device presenting shoulders in a row extending in the direction of key insertion, c) said indicator device comprising notch means on the body and defining said shoulders.

3. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) said indicator device comprising notch means on the body and defining notches in a row extending in the direction of key insertion.

4. The combination of claim 3 wherein said notches are also in a second row on the opposite side of the body.

5. The combination of claim 4 including graphic representation of keys on both sides of the body, the representation having teeth presented toward said notches.

6. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, said indicator device presenting shoulders in a row extending in the direction of key insertion, c) said indicator device comprising a boot on the body carrying said shoulders at associated notches.

7. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) and wherein said indicator device comprising a boot on the body, said boot being elongated at the side of the body corresponding to the key teeth location upon key insertion into the receptor.

8. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) and including a graphic representation of a key on one side of the body, the representation having teeth presented toward notches defined by said device.

9. In combination with a padlock having a body, a U-shaped keeper at one end of the body, and a key receptor at the opposite end of the body, the body containing a row of pins to be engaged by key teeth, the combination comprising:

a) an indicator device on the body, b) said device having a location on the body relative to the pins to indicate the left or right directional orientation of key teeth insertion into said receptor, to effect opening of the padlock keeper, c) and wherein said indicator device comprises a row of shoulders proximate an edge of the body toward which the key teeth are to be presented.

10. The combination of claim 9 wherein said shoulders are formed by one of the following:

i) indentations in the body ii) projections on the body.

* * * * *